US007899377B2

(12) United States Patent
Osawa et al.

(10) Patent No.: US 7,899,377 B2
(45) Date of Patent: Mar. 1, 2011

(54) IMAGE FORMING APPARATUS

(75) Inventors: Fujio Osawa, Saitama (JP); Hajime Misumi, Saitama (JP); Hideo Kageyama, Saitama (JP); Takashi Kubo, Saitama (JP); Mitsunori Shioi, Saitama (JP); Kanou Saitou, Saitama (JP); Susumu Takagaki, Saitama (JP); Tadakazu Tsutehira, Saitama (JP); Yuji Sato, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 20 days.

(21) Appl. No.: 12/540,071

(22) Filed: Aug. 12, 2009

(65) Prior Publication Data

US 2010/0226694 A1 Sep. 9, 2010

(30) Foreign Application Priority Data

Mar. 4, 2009 (JP) ..... 2009-050650

(51) Int. Cl.
*G03G 15/01* (2006.01)

(52) U.S. Cl. ..... 399/301; 399/49; 399/72

(58) Field of Classification Search ..... 399/38, 399/46, 49, 72, 297–303
See application file for complete search history.

(56) References Cited

U.S. PATENT DOCUMENTS 6,614,506 B2 * 9/2003 Kodama et al. ..... 355/32
7,313,352 B2 * 12/2007 Shinohara et al. ..... 399/301
7,415,231 B2 * 8/2008 Maeda ..... 399/301
7,493,072 B2 * 2/2009 Sato et al. ..... 399/301

FOREIGN PATENT DOCUMENTS

JP A-2000-305336 11/2000
JP A-2002-357940 12/2002
JP A-2003-005490 1/2003

* cited by examiner

*Primary Examiner*—Hoan Tran
(74) *Attorney, Agent, or Firm*—Oliff & Berridge, PLC

(57) ABSTRACT

An image forming apparatus includes: a plurality of image forming units as defined herein; an image carrier as defined herein; a first operation controlling unit as defined herein; a second operation controlling unit as defined herein; a density detecting sensor that detects densities of the images formed on the image carrier; a measuring unit that binarizes a density detection output of the image position deviation correction patterns formed on the image carrier, from the density detecting sensor, and that measures intervals between color patterns of the image position deviation correction patterns, based on the binarized output; and a position deviation correction controlling unit that performs a position deviation correcting control of, when the intervals measured by the measuring unit and of the color patterns in the image position deviation correction patterns are deviated from a predetermined range, correcting position deviation of the toner images formed by the image forming units.

4 Claims, 10 Drawing Sheets

REGI ADJUSTMENT PATCHES FOR HIGH-SPEED MODE

REGI ADJUSTMENT PATCHES FOR LOW-SPEED MODE

COMPARISON WITH REFERENCE FOR HIGH-SPEED MODE

COMPARISON WITH REFERENCE FOR LOW-SPEED MODE

FOR (1/1)V (MAXIMUM SPEED)

FOR (1/2)V

FOR (1/3)V

FOR (1/1)V

FOR (1/2)V

FOR (1/3)V

IMAGE FORMING APPARATUS

CROSS-REFERENCE TO RELATED APPLICATIONS

This application is based on and claims priority under 35 USC 119 from Japanese Patent Application No. 2009-050650 filed on Mar. 4, 2009.

BACKGROUND

1. Technical Field

The present invention relates to an image forming apparatus.

2. Related Art

As an image forming apparatus which performs color printing, there is a tandem type apparatus in which image forming sections (photosensitive members, exposing devices, and the like) that transfer toner images of colors (Y (yellow), M (magenta), C (cyan), and K (black)) to a sheet are provided respectively for the colors.

In the tandem type image forming apparatus, the respective image forming sections perform a printing operation on one sheet to form a color image configured by toner images of the four colors.

When transfer timings of the image forming sections are caused to be delicately deviated from one another by a temperature rise in the apparatus, a temporal change, or the like, therefore, so-called misregistration in which only a specific color is printed while being deviated in one image occurs.

As a registration adjusting technique for correcting the misregistration, known is a technique in which each image forming section forms a registration adjustment patch (hereinafter, referred to as regi adjustment patch) configured by a toner image on a transfer belt, the regi adjustment patches for the colors on the transfer belt are detected by a sensor, the amount of deviating from a reference position is calculated, and the writing timing of the image forming section or the like is corrected so as to eliminate the misregistration amount.

SUMMARY

However, a density sensor which detects a regi adjustment patch has a low responsibility. When the printing speed is high and a transfer/conveyor belt on which a patch is formed is moved at a high speed, therefore, the output of a sensor which measures the patch often fails to have a value necessary for detecting the patch.

As shown in FIG. 10, in the case the output of the sensor which measures the patch cannot obtain a sufficient value which is equal to or larger than a threshold, as in Y (yellow) (reference numeral 1001) or C (cyan) (reference numeral 1002), when the output value is binarized, the patch cannot detected.

According to an aspect of the invention, there is provided an image forming apparatus including: a plurality of image forming units which form toner images of different colors, respectively; an image carrier onto which the color toner images respectively formed by the image forming units are transferred, and which carries the color toner images; a first operation controlling unit which performs a first operation control of driving the image forming units and the image carrier in accordance with a printing speed that is selectively designated from a plurality of printing speeds, and transferring the color toner images formed by the image forming units to a recording medium; a second operation controlling unit which performs a second operation control of activating a position deviation correction mode where position deviations of the toner images formed by the image forming units are corrected, driving the image forming units and the image carrier, and forming image position deviation correction patterns of the colors on the image carrier, the patterns having a size and axis-to-axis distance that correspond to the currently set printing speed; a density detecting sensor which detects densities of the images formed on the image carrier; a measuring unit which binarizes a density detection output of the image position deviation correction patterns formed on the image carrier, from the density detecting sensor, and which measures intervals between color patterns of the image position deviation correction patterns, based on the binarized output; and a position deviation correction controlling unit which performs a position deviation correcting control of, when the intervals measured by the measuring unit and of the color patterns in the image position deviation correction patterns are deviated from a predetermined range, correcting position deviation of the toner images formed by the image forming units.

BRIEF DESCRIPTION OF THE DRAWINGS

Exemplary embodiments of the present invention will be described in detail based on the following figures, wherein.

DESCRIPTION OF REFERENCE NUMBERALS AND SIGNS

Figure 1:
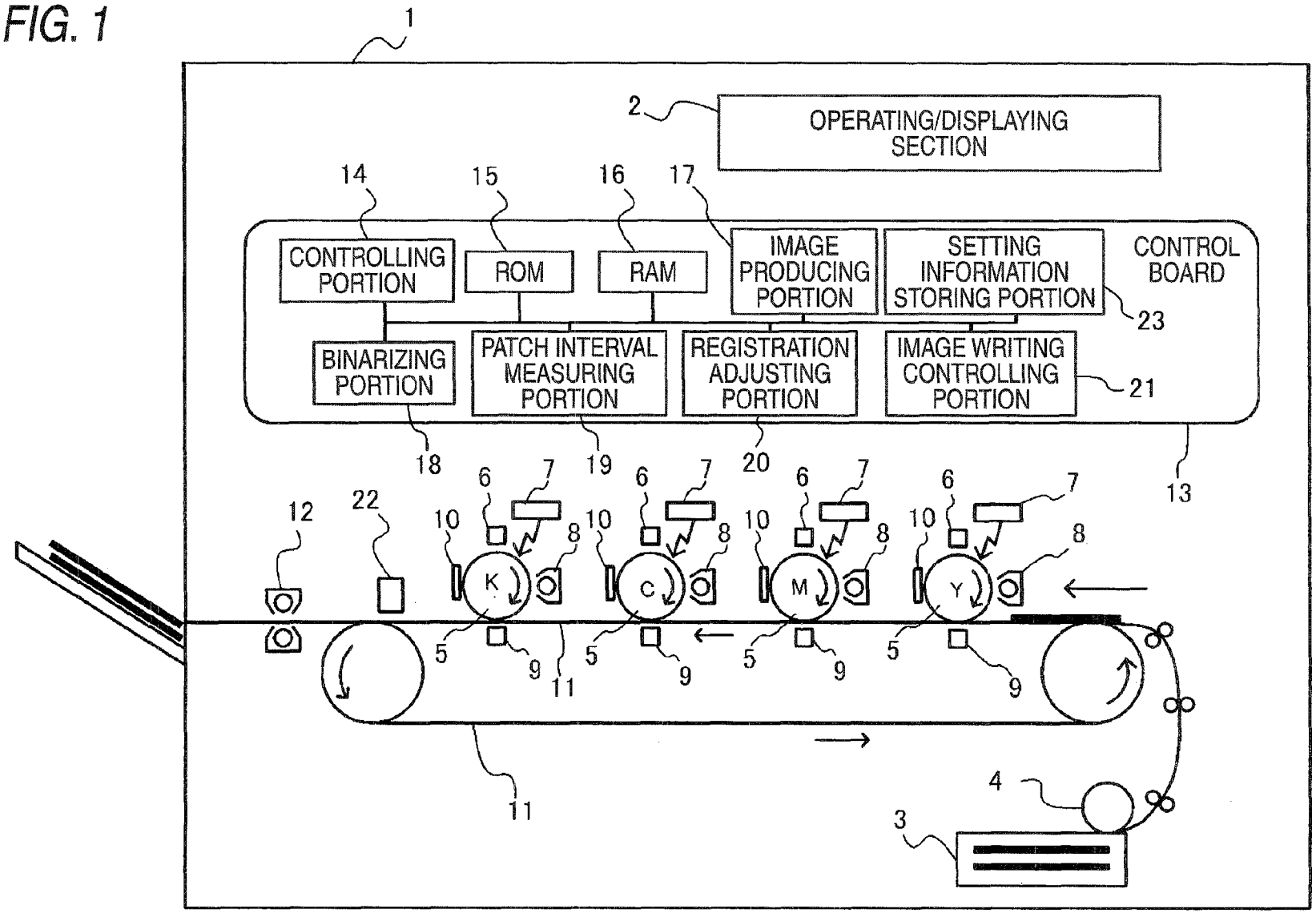
FIG. 1 is a diagram showing a functional configuration of an image forming apparatus 1.

1 image forming apparatus
7 exposing device
11 transfer/conveyor belt
14 controlling portion
18 binarizing portion
19 patch interval measuring portion
20 registration adjusting portion
21 image writing controlling portion
22 density sensor
23 setting information storing portion

DETAILED DESCRIPTION

Hereinafter, examples of the invention will be described in detail with reference to the accompanying drawings.

First, an image forming apparatus 1 will be described with reference to FIG. 1.

FIG. 1 is a diagram showing a functional configuration of the image forming apparatus 1.

As shown in FIG. 1, the image forming apparatus 1 has an operating/displaying section 2, a sheet feeding tray 3, a pickup roller 4, photosensitive members 5, charging devices 6, exposing devices 7, developing devices 8, transferring devices 9, cleaners 10, a transfer/conveyor belt 11, a fixing device 12, a control board 13, and a density sensor 22.

The image forming apparatus 1 is a printing apparatus which prints a print job that is received from the outside. Alternatively, the image forming apparatus may be a multi-function apparatus having functions of, for example, forming an image of copied data on a sheet, and forming an image of facsimile data on a sheet.

The operating/displaying section 2 is configured by a liquid crystal touch panel, displays information to the user, and receives instructions from the user.

The sheet feeding tray 3 stores sheets which are to be used in the printing in the image forming apparatus 1.

The pickup roller 4 feeds the sheets stored in the sheet feeding tray 3, to a conveying path.

In each of the photosensitive members 5, an electrostatic latent image formed by the corresponding exposing device 7 is developed to a toner image by the corresponding developing device 8.

The toner image formed on the photosensitive member 5 is transferred to a sheet conveyed on the transfer/conveyor belt 11, by the corresponding transferring device 9.

The toner which has not been transferred to the sheet to remain on the photosensitive member 5 is cleaned by the corresponding cleaner 10.

The image forming apparatus 1 is a tandem type apparatus, and, as shown in FIG. 1, four kinds of image forming sections each configured by the photosensitive member 5, the charging device 6, the exposing device 7, the developing device 8, the transferring device 9, and the cleaner 10 are used dedicatedly for Y (yellow), M (magenta), C (cyan), and K (black), respectively.

The toner images of Y (yellow). M (magenta), C (cyan), and K (black) are sequentially transferred from the photosensitive members 5 for respective colors onto the sheet conveyed by the transfer/conveyor belt 11.

With respect to regi adjustment patches, the patch for Y (yellow) is transferred from the photosensitive member 5 for Y (yellow) to the transfer/conveyor belt 11, the patch for M (magenta) is transferred from the photosensitive member 5 for M (magenta) to the transfer/conveyor belt 11, the patch for C (cyan) is transferred from the photosensitive member 5 for C (cyan) to the transfer/conveyor belt 11, and the patch for K (black) is transferred from the photosensitive member 5 for K (black) to the transfer/conveyor belt 11.

The regi adjustment patches transferred to the transfer/conveyor belt 11 are moved below the density sensor 22 in accordance with the movement of the transfer/conveyor belt 11, and measured by the density sensor 22.

The sheet onto which the toner images are transferred is sent to the fixing device 12, the toner images are fixed to the sheet, and then the sheet is discharged to the outside of the apparatus.

The control board 13 includes a controlling portion 14, a ROM (Read Only Memory) 15, a RAM (Random Access Memory) 16, an image producing portion 17, a binarizing portion 18, a patch interval measuring portion 19, a registration adjusting portion 20, an image writing controlling portion 21, and a setting information storing portion 23.

The controlling portion 14 is configured by a CPU (Central Processing Unit), and generally controls the image forming apparatus 1.

The ROM 15 stores firmware for operating the image forming apparatus 1, and the like.

The RAM 16 functions as work area for storing various kinds of information such as system data for controlling the operation of the apparatus.

The image producing portion 17 produces a bitmap image for producing an image on a sheet.

The binarizing portion 18 receives data detected from the regi adjustment patches, from the density sensor 22, binarizes the data with respect to a predetermined threshold, and sends the binarized data to the patch interval measuring portion 19.

The patch interval measuring portion 19 measures patch intervals of the regi adjustment patches on the transfer/conveyor belt, on the basis of the data sent from the binarizing portion 18.

Based on the regi adjustment patch intervals measured by the patch interval measuring portion 19, the registration adjusting portion 20 calculates misregistration amounts respectively indicating the degrees by which the intervals of the regi adjustment patches deviate from a predetermined reference value, and controls the image writing controlling portion 21 so as to eliminate the misregistration amounts.

By the control which is performed on the image writing controlling portion 21 by the registration adjusting portion 20, a control of the writing timing of the exposing device 7 dedicated for the color to be adjusted, and the like is performed, so that the deviation of the writing timing of the color is corrected.

In order to allow the bitmap image produced by the image producing portion 17 to be printed, the image writing controlling portion 21 controls electrostatic-latent image writings in which the exposing devices 7 dedicated for the respective colors form electrostatic latent images on the photosensitive members 5 dedicated for the respective colors.

The setting information storing portion 23 stores data related to the registration adjustment, such as the sizes of the regi adjustment patches, the reference value of patch intervals, etc.

The density sensor 22 measures the density of a patch which is formed on the transfer/conveyor belt, and may be configured by, for example, an optical density sensor which receives reflected light to measure the density.

The density sensor 22 is used also for measuring the density of a patch for process control adjustment.

In the thus configured image forming apparatus 1, there is a case where the timings of writing the electrostatic latent images onto the photosensitive members 5 are delicately deviated from one another by a temperature rise in the image forming apparatus 1, a temporal change, or the like, and hence so-called misregistration in which only a specific color is printed while being deviated occurs. In order to correct the misregistration, color registration adjustment is performed.

For example, the color registration adjustment is performed in the following manner. The regi adjustment patches for Y (yellow), M (magenta), C (cyan), and K (black) are formed on the transfer/conveyor belt 11 by image producing sections for the respective colors. The regi adjustment patches are measured by the density sensor 22. The amounts by which the intervals of the measured regi adjustment patches deviate from the reference value are calculated. The registration adjusting portion 20 controls the writing timings of the image writing controlling portion 21 so as to eliminate the misregistration amounts.

Next, the process of calculating the misregistration amounts from the regi adjustment patches which are formed on the transfer/conveyor belt 11 in the image forming apparatus 1 will be described in more detail with reference to FIG. 2.

Figure 2:
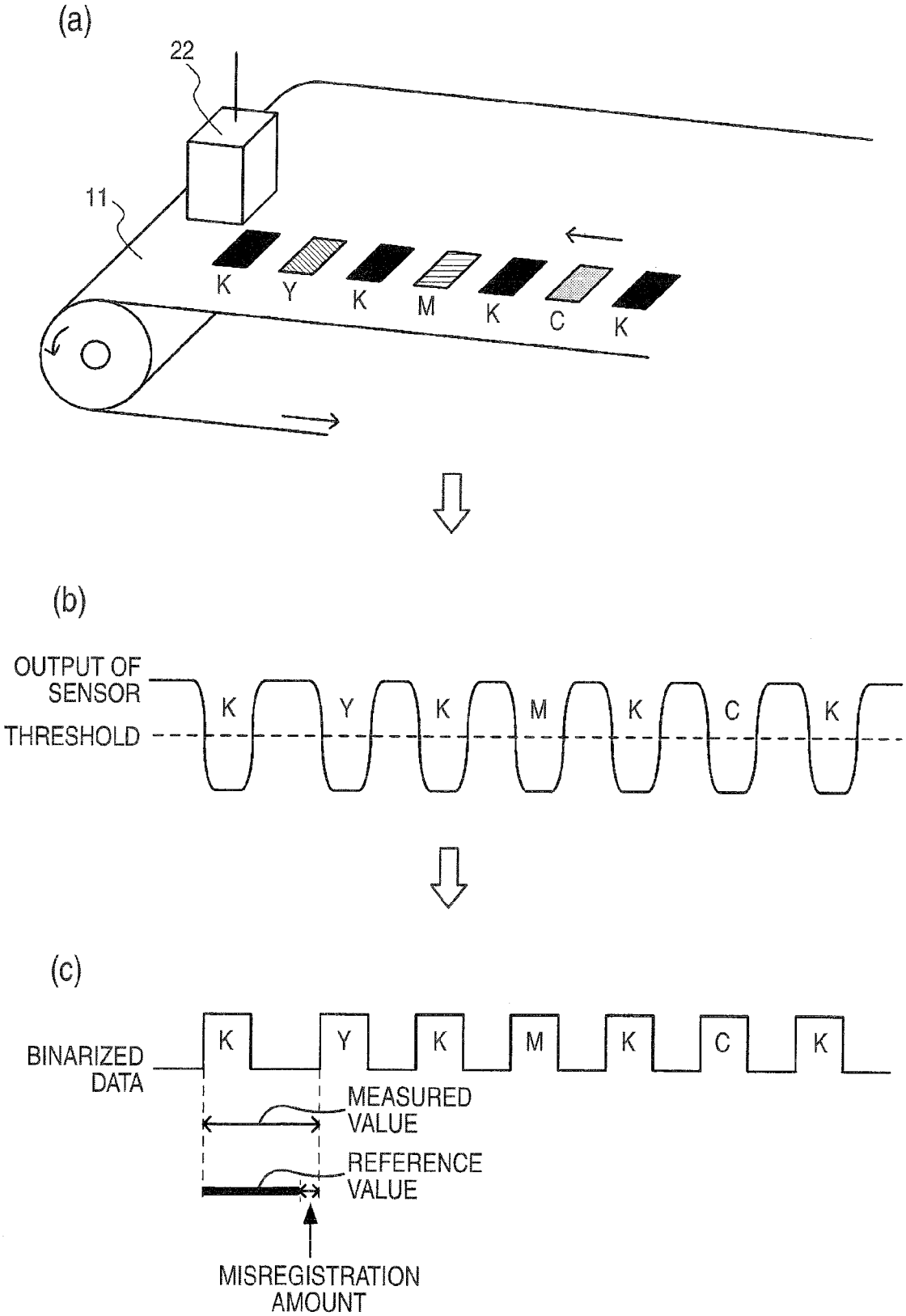
FIG. 2 is a view showing a process of calculating misregistration amounts from regi adjustment patches.

In FIG. 2, (a) is a diagram of the regi adjustment patches formed on the transfer/conveyor belt 11, (b) is a graph showing data output from the density sensor, and (c) is a graph showing data which are obtained by binarizing the data output from the density sensor 22, in the binarizing portion 18.

In the case where color registration adjustment is necessary, the exposing devices 7 respectively dedicated for the colors write electrostatic latent images of regi adjustment patches onto the respective photosensitive members 5 of a predetermined timing, toner images are developed, and regi adjustment patches for Y (yellow), M (magenta), C (cyan), and K (black) are formed on the transfer/conveyor belt 11 ((a) FIG. 2).

The image writing controlling portion 21 controls the timings when the exposing devices 7 write the electrostatic latent images so that the intervals of the color regi adjustment patches formed on the transfer/conveyor belt 11 coincide with the predetermined reference value.

The regi adjustment patches formed on the transfer/conveyor belt 11 are measured by the density sensor 22 in accordance with the movement of the transfer/conveyor belt 11.

Analog data which are measured by the density sensor 22 as shown in (b) of FIG. 2 are supplied to the binarizing portion 18.

The data supplied to the binarizing portion 18 are binarized with respect to the threshold, so that portions where a regi adjustment patch exceeding the predetermined threshold is detected are set to "1" in binary notation, and the other portions are set to "0".

On the basis of the binary data which are output from the binarizing portion 18 in this way, as shown in (c) of FIG. 2, for example, the length from the position where the regi adjustment patch for K (black) starts to be written to that where the regi adjustment patch for Y (yellow) starts to be written is measured.

When the length from the position where the regi adjustment patch for K (black) starts to be written to that where the regi adjustment patch for Y (yellow) starts to be written is measured as shown in (c) of FIG. 2, the measurement value is compared with the initially assumed reference value, and the difference between the measured value and the reference value is calculated as a misregistration amount.

The registration adjusting portion 20 adjusts the image writing controlling portion 21 so that the misregistration amount by which the measurement value is deviated from the reference value is corrected, thereby performing the color registration adjustment.

In the image forming apparatus 1, a plurality of printing speeds can be set. In the case where printing on a large number of sheets is performed for a short time period, for example, the printing speed is set to be high, and, in the case where priority is given to the printing quality than the printing speed, the printing speed is set to be low.

The printing speed can be changed by, for example, changing the moving speeds of the transfer/conveyor belt 11 and the photosensitive members 5.

Hereinafter, the image forming apparatus 1 will be described by way of illustrating Examples 1 and 2 which are different from each other in kind of the regi adjustment patches formed on the transfer/conveyor belt 11.

In Example 1, the image forming apparatus 1 will be described in which regi adjustment patches are formed in different manners in cases where the printing speed is set to a high-speed mode and the moving speed of the transfer/conveyor belt 11 is high, and where the printing speed is set to a low-speed mode and the moving speed of the transfer/conveyor belt 11 is low.

In Example 2, the image forming apparatus 1 will be described in which, when the maximum moving speed of the transfer/conveyor belt 11 is indicated by V, there exist regi adjustment patches in the case where the moving speed of the transfer/conveyor belt 11 is V, those in the case where the moving speed of the transfer/conveyor belt 11 is (½)V, and those in the case where the moving speed of the transfer/conveyor belt 11 is (⅓)V.

EXAMPLE 1

The image forming apparatus 1 in which there are regi adjustment patches for the high-speed mode where the printing speed is high, and those for the low-speed mode where the printing speed is low will be described.

The regi adjustment patches in the case where the printing speed is set to the high-speed mode (the case where the transfer/conveyor belt 11 is moved at a high speed), and those in the case where the printing speed is set to the low-speed mode (the case where the transfer/conveyor belt 11 is moved at a low speed) will be summarily described with reference to FIGS. 3A and 3B.

Figure 3A:
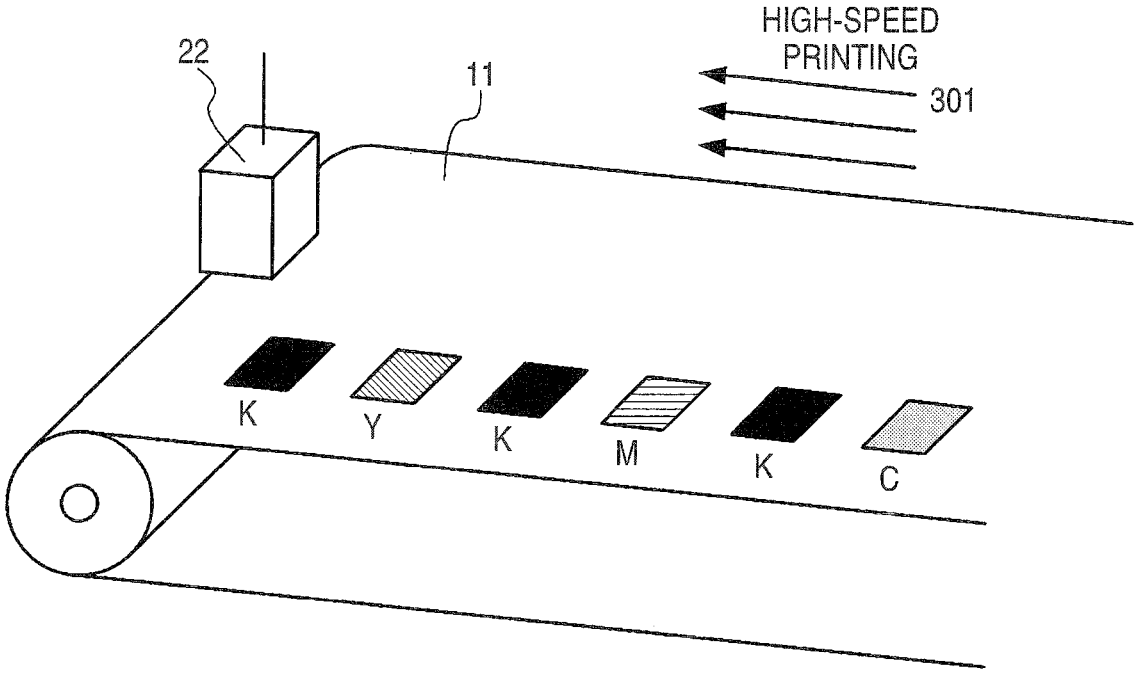
FIGS. 3A and 3B are views showing respectively regi adjustment patches for a high-speed mode and regi adjustment patches for a low-speed mode.
Figure 3B:
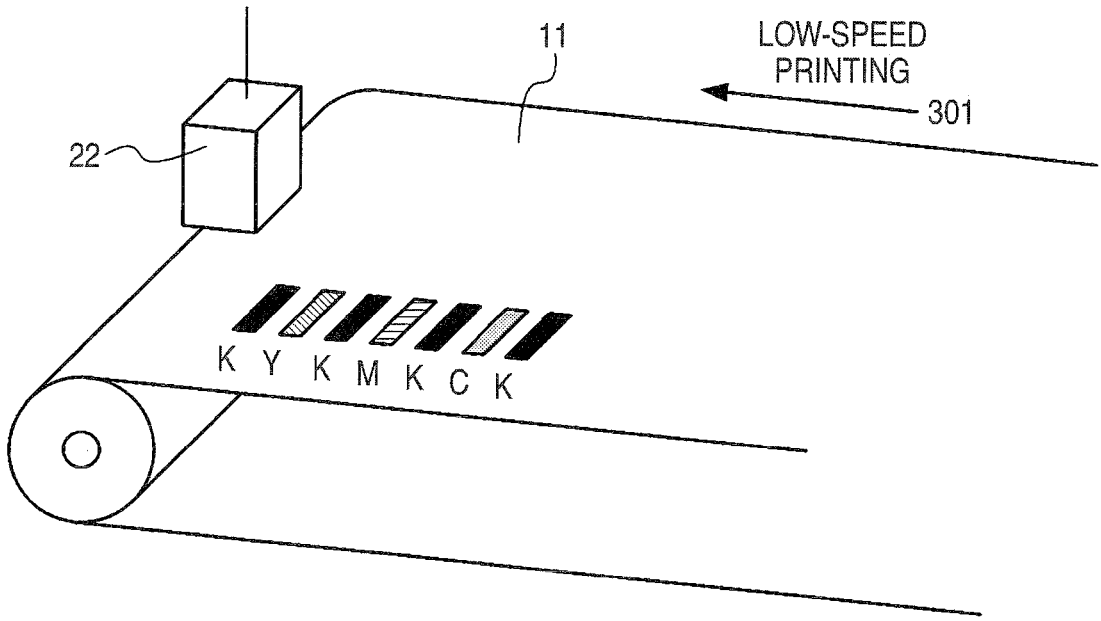

FIGS. 3A and 3B are diagrams showing the regi adjustment patches for the high- and low-speed modes, FIG. 3A is a diagram showing the regi adjustment patches for the high-speed mode in the case where the printing speed is set to the high-speed mode, and FIG. 3B is a diagram showing those for the low-speed mode in the case where the printing speed is set to the low-speed mode.

As shown in FIGS. 3A and 3B, the regi adjustment patches for the high-speed mode are formed so that their lengths are longer in the sheet conveying direction (the arrow 301) than those of the regi adjustment patches for the low-speed mode, in order that, even when the transfer/conveyor belt 11 is moved at a higher speed, the patches are detected by the binarizing portion 18.

As described above, the regi adjustment patches for the high-speed mode are formed longer than those for the low-speed mode. Even when the printing speed of the image forming apparatus 1 is high and the transfer/conveyor belt 11 is moved at a higher speed, therefore, the output of the density sensor which measures the regi adjustment patches has a value sufficient for patch detection which is performed after the data are binarized in the binarizing portion 18.

Next, the regi adjustment patches for the high- and low-speed modes will be described in more detail with reference to FIG. 4.

Figure 4:
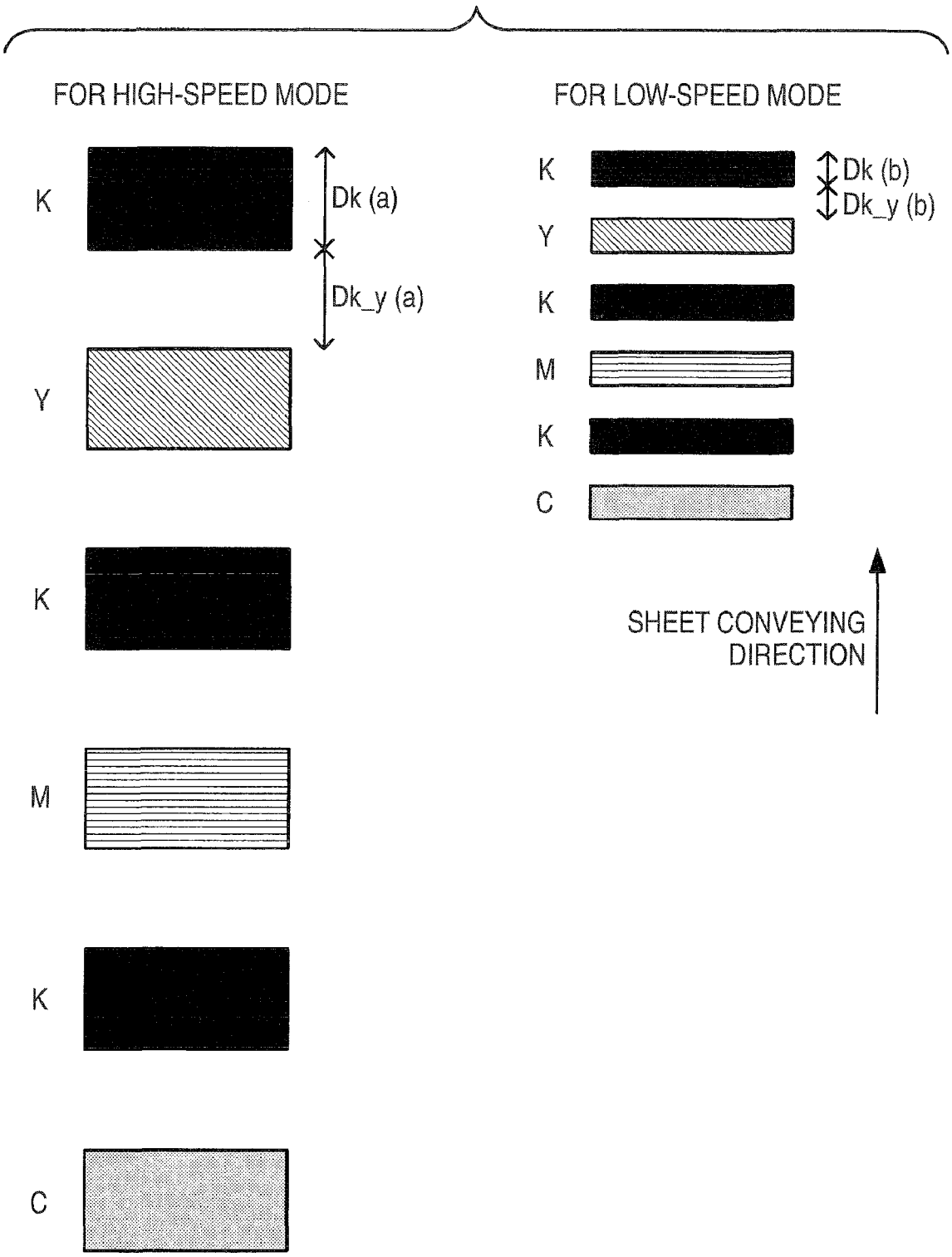
FIG. 4 is a view showing the lengths and intervals of regi adjustment patches for the high- and low-speed modes.

FIG. 4 is a diagram showing the lengths of the regi adjustment patches for the high- and low-speed modes.

As shown in FIG. 4, in the regi adjustment patches for the high-speed mode, the length of a patch of K (black) in the sheet conveying direction is indicated by Dk(a), and the patch interval between the patch of K (black) and a patch of Y (yellow) is indicated by Dk_y(a). In the regi adjustment patches for the low-speed mode, the length of a patch of K (black) in the sheet conveying direction is indicated by Dk(b), and the patch interval between the patch of K (black) and a patch of Y (yellow) is indicated by Dk_y(b).

As shown in FIG. 4, the regi adjustment patches for the high- and low-speed modes have relationships of "Dk(a)>Dk(b)" and "Dk_y(a)>Dk_y(b)".

The above-described relationships between the regi adjustment patches for the high- and low-speed modes similarly hold not only for K (black) and Y (yellow), but also for K (black) and M (magenta), and K (black) and C (cyan).

The lengths Dk(a) and Dk(b) and the intervals Dk_y(a) and Dk y(b) are configured so that, in accordance with the moving speed (printing speed) of the transfer/conveyor belt 11 and the response speed of the density sensor 22, an amplitude sufficient for detection of a regi adjustment patch in the binarizing portion 18 can be obtained from the output value of the density sensor. Also with respect to the regi adjustment patches for Y (yellow), M (magenta), and C (cyan), and the patch intervals between K (black) and M (magenta), and K (black) and C (cyan), the lengths and intervals of the regi adjustment patches are similarly configured so that, in accordance with the moving speed (printing speed) of the transfer/conveyor belt 11 and the response speed of the density sensor 22, an amplitude sufficient for detection of a regi adjustment patch in the binarizing portion 18 can be obtained from the output value of the density sensor 22.

Next, a process of performing the registration adjustment in the image forming apparatus 1 will be described with reference to FIG. 5.

Figure 5:
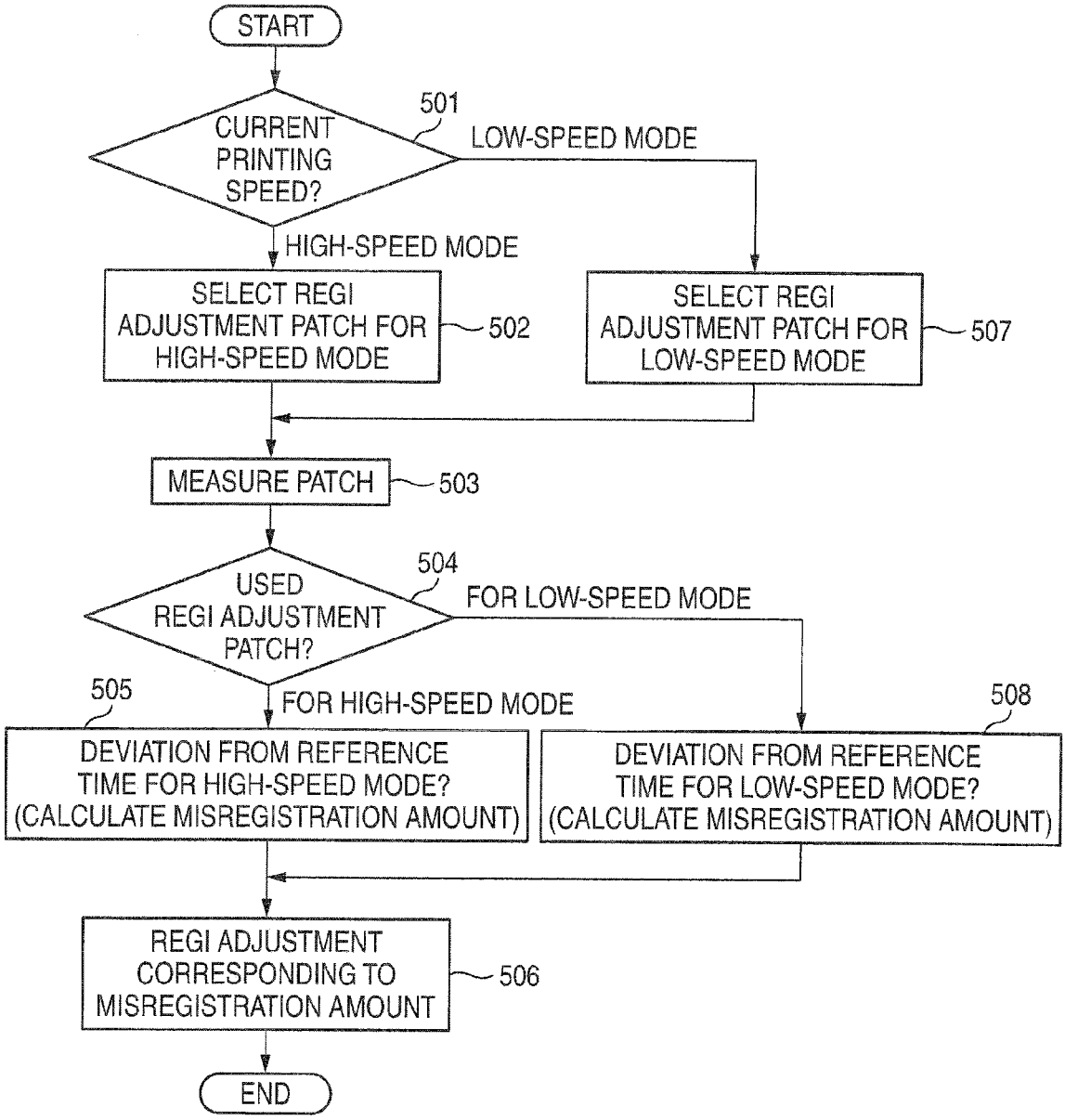
FIG. 5 is a flowchart showing a process in the image forming apparatus 1 (Example 1)

FIG. 5 is a flowchart showing the process of the registration adjustment which is performed in the image forming apparatus 1.

Upon receiving a request for the registration adjustment, the controlling portion 14 activates a registration adjustment mode, and checks whether the speed of printing which is performed in the image forming apparatus 1 is in the high-speed mode or in the low-speed mode (step 501).

If it is checked that the printing speed is in the high-speed mode (HIGH-SPEED MODE in step 501), the image writing controlling portion 21 controls the exposing device 7 so as to form the regi adjustment patches for the high-speed mode on the transfer/conveyor belt 11 (step 502).

Then, the regi adjustment patches for the high-speed mode formed on the transfer/conveyor belt 11 are measured by the density sensor 22, and the data measured by the density sensor 22 are binarized in the binarizing portion 18, and thereafter sent to the patch interval measuring portion 19.

In the patch interval measuring portion 19, it is determined whether the used regi adjustment patches are patches for the high-speed mode or those for the low-speed mode (step 504).

Figure 6A:
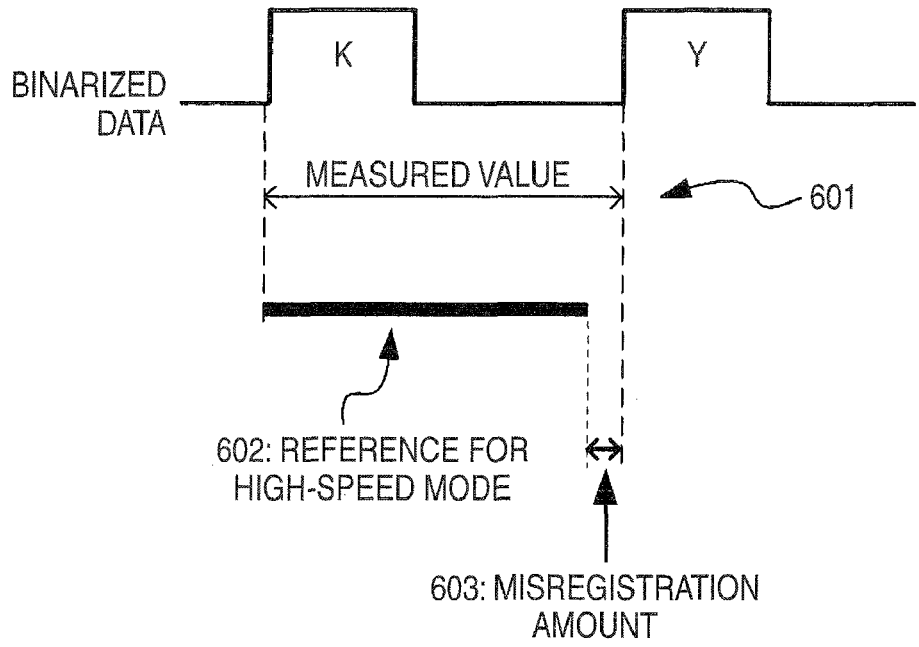
FIGS. 6A and 6B are views showing a process of obtaining a misregistration amount (Example 1)

If the regi adjustment patches for the high-speed mode are used, as shown in FIG. 6A, the patch interval measuring portion 19 compares the measurement value (reference numeral 601) which is in the data sent from the binarizing portion 18, and which is obtained by measuring the length from the position where K (black) starts to be written to that where Y (yellow) starts to be written, with the reference value (reference numeral 602) for the high-speed mode to calculate the misregistration amount (reference numeral 603) (step 505).

The misregistration amount is calculated not only with respect to K (black) and Y (yellow), but also with respect to K (black) and M (magenta), and K (black) and C (cyan), as far as a misregistration amount exists therebetween.

The misregistration amount calculated by the patch interval measuring portion 19 is sent to the registration adjusting portion 20. The registration adjusting portion 20 performs controls such as that the writing timing of the image writing controlling portion 21 is adjusted so as to eliminate the misregistration amount (step 506).

If it is checked in step 501 that the printing speed is set to the low-speed mode (LOW-SPEED MODE in step 501), the image writing controlling portion 21 controls the exposing device 7 so as to form the regi adjustment patches for the low-speed mode on the transfer/conveyor belt 11 (step 507).

Then, the regi adjustment patches for the low-speed mode formed on the transfer/conveyor belt 11 are measured by the density sensor 22, and the data measured by the density sensor 22 are binarized in the binarizing portion 18, and thereafter sent to the patch interval measuring portion 19.

Figure 6B:
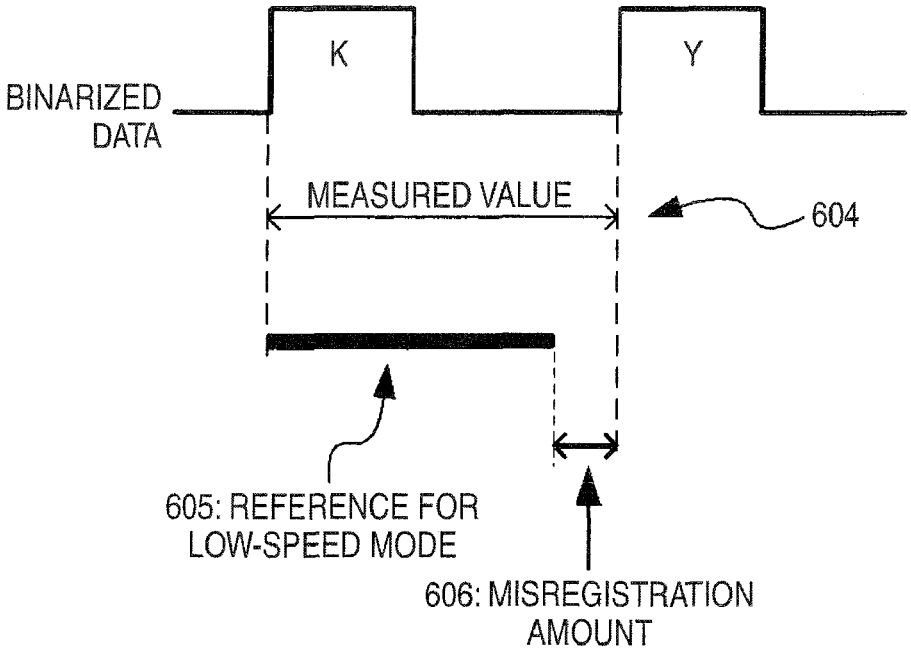

In the patch interval measuring portion 19, it is determined whether the used regi adjustment patches are patches for the high-speed mode or those for the low-speed mode (step 504). If the regi adjustment patches for the low-speed mode are used, as shown in FIG. 6B, the patch interval measuring portion 19 compares the measurement value (reference numeral 604) which is in the data sent from the binarizing portion 18, and which is obtained by measuring the length from the position where K (black) starts to be written to that where Y (yellow) starts to be written, with the reference value (reference numeral 605) for the low-speed mode to calculate the misregistration amount (reference numeral 606) (step 508).

The misregistration amount is calculated not only with respect to K (black) and Y (yellow), but also with respect to K (black) and M (magenta), and K (black) and C (cyan), as far as a misregistration amount exists therebetween.

The misregistration amount calculated by the patch interval measuring portion 19 is sent to the registration adjusting portion 20. The registration adjusting portion 20 performs controls such as that the writing timing of the image writing controlling portion 21 is adjusted so as to eliminate the misregistration amount (step 506).

The adjustment of eliminating the misregistration amount calculated from the regi adjustment patches for the high-speed mode can be reflected also in the printing process in the low-speed mode, and that of eliminating the misregistration amount calculated from the regi adjustment patches for the low-speed mode can be reflected also in the printing process in the high-speed mode.

The setting information storing portion 23 previously stores: the lengths Dk(a), Dy(a), Dm(a), and Dc(a) of K (black), Y (yellow), M (magenta), and C (cyan) of the regi adjustment patches for the high-speed mode; in the regi adjustment patches for the high-speed mode, the patch interval Dk_y(a) between K (black) and Y (yellow), the patch interval Dk_m(a) between K (black) and M (magenta), and the patch interval Dk_c(a) between K (black) and C (cyan); the lengths Dk(b), Dy(b), Dm(b), and Dc(b) of K (black), Y (yellow), M (magenta), and C (cyan) of the regi adjustment patches for the low-speed mode; and, in the regi adjustment patches for the low-speed mode, the patch interval Dk_y(b) between K (black) and Y (yellow), the patch interval Dk_m (b) between K (black) and M (magenta), and the patch interval Dk_c(b) between K (black) and C (cyan).

In step 504, alternatively, it may not be determined whether the used regi adjustment patches are patches for the high-speed mode or those for the low-speed mode, but instead it may be determined whether the printing speed of the image forming apparatus 1 is set to the high-speed mode or the low-speed mode. If the printing speed is set to the high-speed mode, it may be determined that the patches for the high-speed mode are used, and the process may then proceed to step 505, and, if the printing speed is set to the low-speed mode, it may be determined that the patches for the low-speed mode are used, and the process may then proceed to step 508.

Although the image forming apparatus 1 has been described as a tandem type image forming apparatus using the direct transfer system, a tandem type image forming apparatus using the secondary transfer system may be used.

EXAMPLE 2

The image forming apparatus 1 will be described in which, in the case where the printing speed of the image forming apparatus 1 is deemed as the moving speed of the transfer/conveyor belt 11 and the maximum moving speed of the transfer/conveyor belt 11 is indicated by V, there exist regi adjustment patches in the case where the moving speed of the transfer/conveyor belt 11 is V, those in the case where the moving speed of the transfer/conveyor belt 11 is (½)V, and those in the case where the moving speed of the transfer/conveyor belt 11 is (⅓)V, according to a change of the printing speed.

Figure 7A:
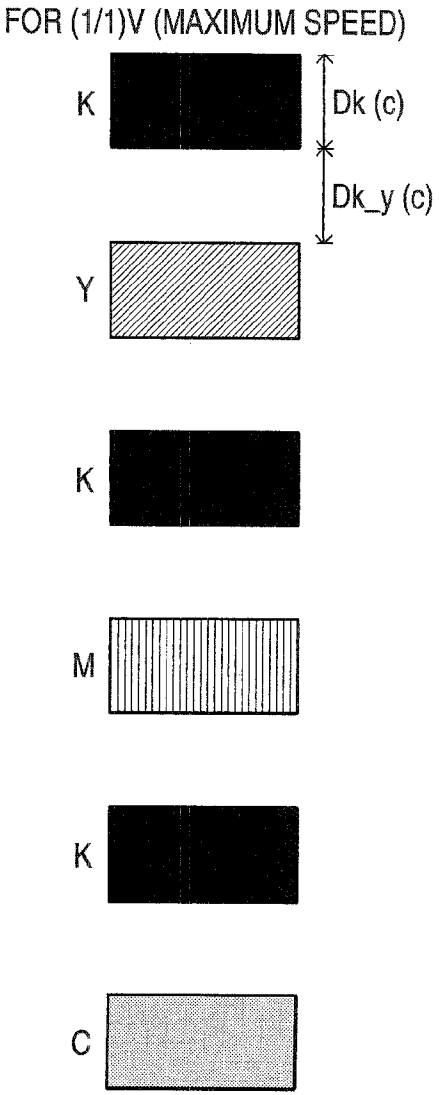
FIGS. 7A to 7C are views showing the lengths and intervals of regi adjustment patches corresponding to printing speeds.
Figure 7B:
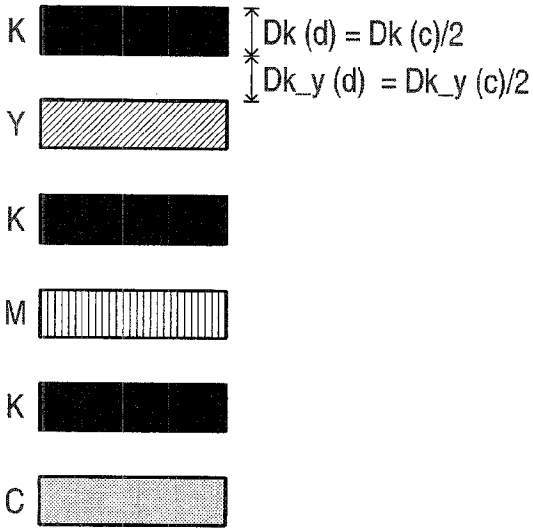
Figure 7C:
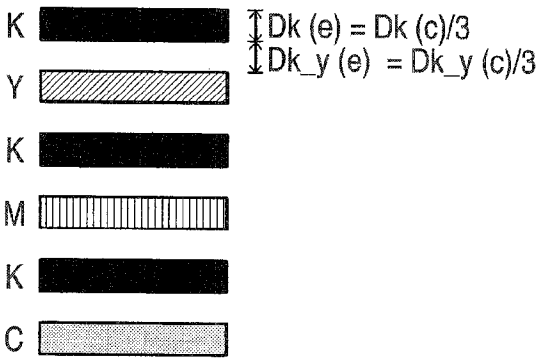

FIGS. 7A to 7C are diagrams showing regi adjustment patches in the respective printing speeds. FIG. 7A is a diagram showing the regi adjustment patches in the case where the moving speed of the transfer/conveyor belt 11 is V, FIG. 7B is a diagram showing those in the case where the moving speed of the transfer/conveyor belt 11 is (½)V, and FIG. 7C is a diagram showing those in the case where the moving speed of the transfer/conveyor belt 11 is (⅓)V.

As shown in FIGS. 7A to 7C, in the regi adjustment patches, the length of a patch of K (black) in the sheet conveying direction in the case where the moving speed of the transfer/conveyor belt 11 is maximum or V is indicated by Dk(c), that of a patch of K (black) in the sheet conveying direction in the case where the moving speed of the transfer/conveyor belt 11 is (½)V is indicated by Dk(d), and that of a patch of K (black) in the sheet conveying direction in the case where the moving speed of the transfer/conveyor belt 11 is (⅓)V is indicated by Dk(e).

Then, Dk(c), Dk(d), and Dk(e) have relationships of "Dk(d)=[Dk(c)/2]" and "Dk(e)=[Dk(c)/3]".

In the case where the moving speed of the transfer/conveyor belt 11 is V', the length of a patch of K (black) of the regi adjustment patches in the sheet conveying direction is indicated by Dk(x), and Dk(c) and Dk(x) have a relationship of "Dk(x)=(V'/V)×Dk(c)".

As described above, the moving speed (printing speed) of the transfer/conveyor belt 11 is in proportional relationship with the length of a patch of K (black) in the regi adjustment patches in the sheet conveying direction.

The above-described relationships between the moving speed (printing speed) of the transfer/conveyor belt 11 and the lengths of the regi adjustment patches hold not only for K (black)), but also for Y (yellow), M (magenta), and C (cyan).

As shown in FIGS. 7A to 7C, in the case where the moving speed of the transfer/conveyor belt 11 is maximum or V, the interval between the regi adjustment patch of K (black) and that of Y (yellow) is indicated by Dk_y(c), and, in the case where the moving speed of the transfer/conveyor belt 11 is (½)V, the interval between the regi adjustment patch of K (black) and that of Y (yellow) is indicated by Dk_y(d), and, in the case where the moving speed of the transfer/conveyor belt 11 is (⅓)V, the interval between the regi adjustment patch of K (black) and that of Y (yellow) is indicated by Dk_y(e).

Then, Dk_y(c), Dk_y(d), and Dk_y(e) have relationships of "Dk_y(d)=[Dk_y(c)]/2" and "Dk_y(e)=[Dk_y(c)]/3".

In the case where the moving speed of the transfer/conveyor belt 11 is V', the interval between the regi adjustment patch of K (black) and that of Y (yellow) is indicated by Dk_y(x), and Dk_y(c) and Dk_y(x) have a relationship of "Dk_y(x)=(V'/V)×Dk_y(c)".

As described above, the moving speed (printing speed) of the transfer/conveyor belt 11 is in proportional relationship with the interval between the regi adjustment patch of K (black) and that of Y (yellow).

The above-described relationships between the moving speed (printing speed) of the transfer/conveyor belt 11 and the interval between the regi adjustment patches hold not only for K (black) and Y (yellow), but also for K (black) and M (magenta), and K (black) and C (cyan).

As described above, when the printing speed is reduced to ½ or ⅓, also the lengths and intervals of the regi adjustment patches are reduced to ½ or ⅓.

The length (Dk(c)) and interval (Dk_y(c)) of the regi adjustment patches in case where the moving speed of the transfer/conveyor belt 11 is maximum or V are configured so that, in accordance with the moving speed V of the transfer/conveyor belt 11 and the response speed of the density sensor 22, an amplitude sufficient for detection of a regi adjustment patch in the binarizing portion 18 can be obtained from the output value of the density sensor 22. Also with respect to the regi adjustment patches for Y (yellow), M (magenta), and C (cyan), and the patch intervals between K (black) and M (magenta), and K (black) and C (cyan), the lengths and intervals of the regi adjustment patches in case where the moving speed of the transfer/conveyor belt 11 is maximum or V are similarly configured so that, in accordance with the moving speed V of the transfer/conveyor belt 11 and the response speed of the density sensor 22, an amplitude sufficient for detection of a regi adjustment patch in the binarizing portion 18 can be obtained from the output value of the density sensor 22.

These lengths and intervals of regi adjustment patches in the sheet conveying direction corresponding to the moving speed of the transfer/conveyor belt 11 are previously stored in the setting information storing portion 23.

Next, a process of performing the registration adjustment in the image forming apparatus 1 will be described with reference to FIG. 8.

Figure 8:
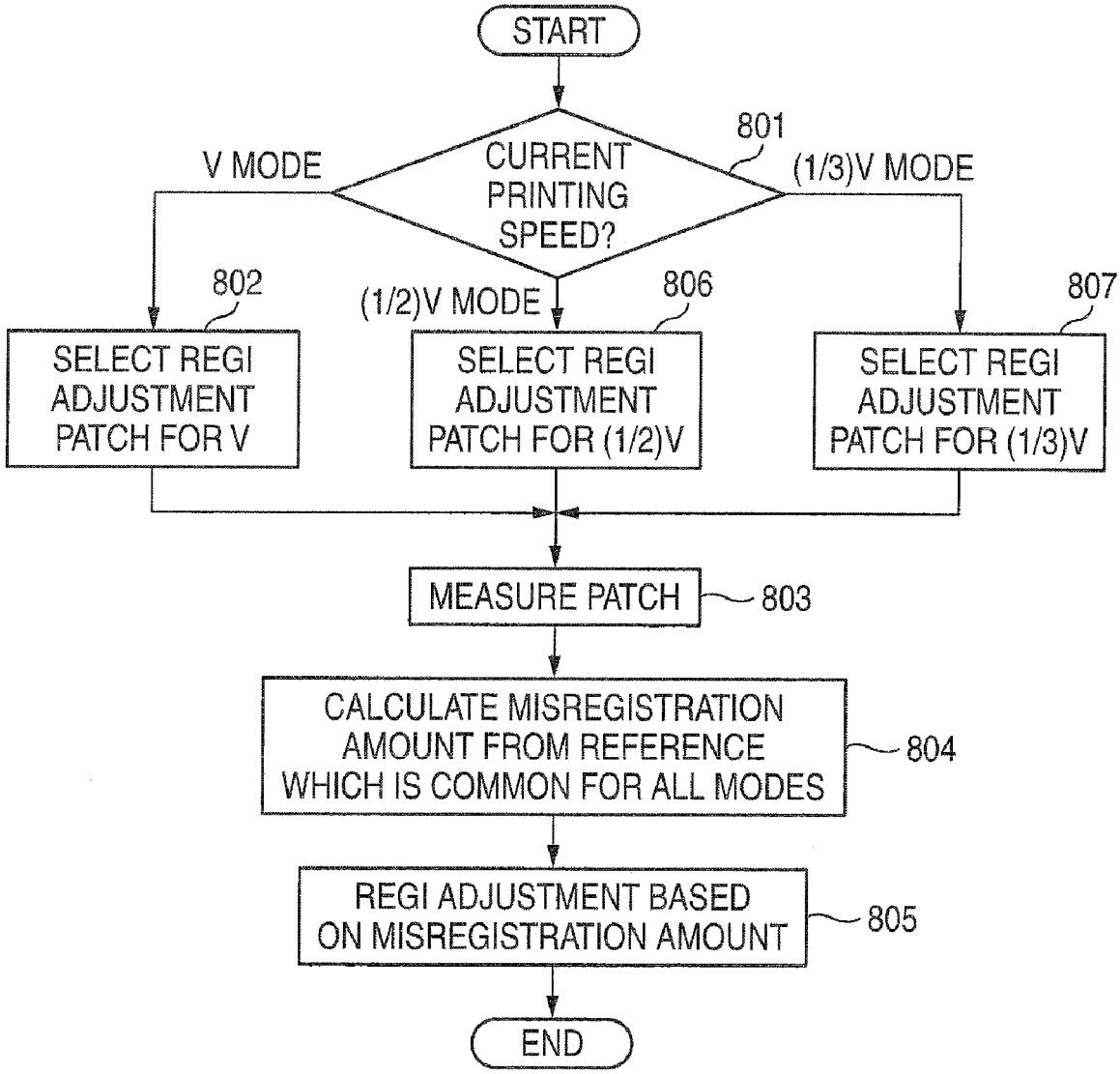
FIG. 8 is a flowchart showing a process in the image forming apparatus 1 (Example 2)

FIG. 8 is a flowchart showing the process of the registration adjustment which is performed in the image forming apparatus 1.

Upon receiving a request for the registration adjustment, the controlling portion 14 activates a registration adjustment mode, and checks whether, when the maximum speed is indicated by V, the speed of the printing which is currently performed in the image forming apparatus 1 is in a V mode, a (½)V mode, or a (⅓)V mode.

The V mode, the (½)V mode, and the (⅓)V mode are previously set in the image forming apparatus 1, and regi adjustment patch lengths and intervals corresponding to the speeds of the modes are previously stored in the setting information storing portion 23.

If it is checked by the controlling portion 14 that the printing speed is set to the V mode (V MODE in step 801), the image writing controlling portion 21 controls the exposing device 7 so that the regi adjustment patches for the moving speed V of the transfer/conveyor belt 11 are formed on the transfer/conveyor belt 11 (step 802).

Then, the regi adjustment patches for the moving speed V of the transfer/conveyor belt 11 which are formed on the transfer/conveyor belt 11 are measured by the density sensor 22, and the data measured by the density sensor 22 are binarized in the binarizing portion 18, and thereafter sent to the patch interval measuring portion 19 (step 803).

Figure 9A:
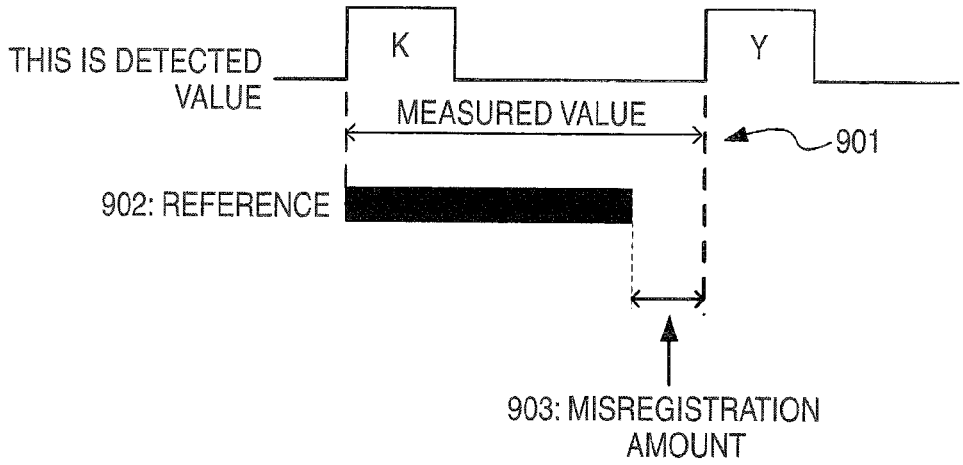
FIGS. 9A to 9C are views showing a process of obtaining a misregistration amount (Example 2) (all references for (1/1) V, (1/2)V, and (1/3)V are equal to one another)

As shown in FIG. 9A, the patch interval measuring portion 19 compares the measurement value (reference numeral 901) which is in the data sent from the binarizing portion 18, and which is obtained by measuring the length from the position where K (black) starts to be written to that where Y (yellow) starts to be written, with a reference value (reference numeral 902) which is common for the all modes (the V mode, the (½)V mode, and the (⅓)V mode) to calculate the misregistration amount (reference numeral 903) (step 804).

The misregistration amount is calculated not only with respect to K (black) and Y (yellow), but also with respect to K (black) and M (magenta), and K (black) and C (cyan), as far as a misregistration amount exists therebetween.

The misregistration amount calculated by the patch interval measuring portion 19 is sent to the registration adjusting portion 20. The registration adjusting portion 20 performs controls such as that the writing timing of the image writing controlling portion 21 is adjusted so as to eliminate the misregistration amount (step 805).

If it is checked in step 801 that the printing speed is set to the (½)V mode ((½)V MODE in step 801), the image writing controlling portion 21 controls the exposing device 7 so that the regi adjustment patches for the moving speed (½)V of the transfer/conveyor belt 11 are formed on the transfer/conveyor belt 11 (step 806).

Then, the regi adjustment patches for the moving speed (½)V formed on the transfer/conveyor belt 11 are measured by the density sensor 22, and the data measured by the density sensor 22 are binarized in the binarizing portion 18, and thereafter sent to the patch interval measuring portion 19 (step 803).

Figure 9B:
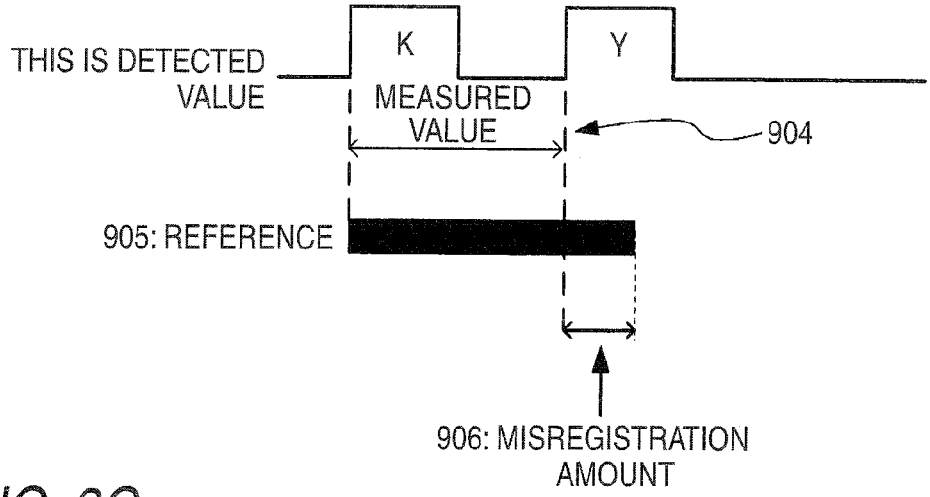

As shown in FIG. 9B, the patch interval measuring portion 19 compares the measurement value (reference numeral 904) which is in the data sent from the binarizing portion is, and which is obtained by measuring the length from the position where K (black) starts to be written to that where Y (yellow) starts to be written, with the reference value (reference numeral 905) which is common for the all modes (the V mode, the (½)V mode, and the (⅓)V mode) to calculate the misregistration amount (reference numeral 906) (step 804).

The misregistration amount is calculated not only with respect to K (black) and Y (yellow), but also with respect to K (black) and M (magenta), and K (black) and C (cyan), as far as a misregistration amount exists therebetween.

The misregistration amount calculated by the patch interval measuring portion 19 is sent to the registration adjusting portion 20. The registration adjusting portion 20 performs controls such as that the writing timing of the image writing controlling portion 21 is adjusted so as to eliminate the misregistration amount (step 805).

If it is checked in step 801 that the printing speed is set to the (⅓)V mode ((⅓)V MODE in step 801), the image writing controlling portion 21 controls the exposing device 7 so that the regi adjustment patches for the moving speed (⅓)V of the transfer/conveyor belt 11 are formed on the transfer/conveyor belt 11 (step 807).

Then, the regi adjustment patches for the moving speed (⅓)V formed on the transfer/conveyor belt 11 are measured by the density sensor 22, and the data measured by the density sensor 22 are binarized in the binarizing portion 18, and thereafter sent to the patch interval measuring portion 19 (step 803).

Figure 9C:
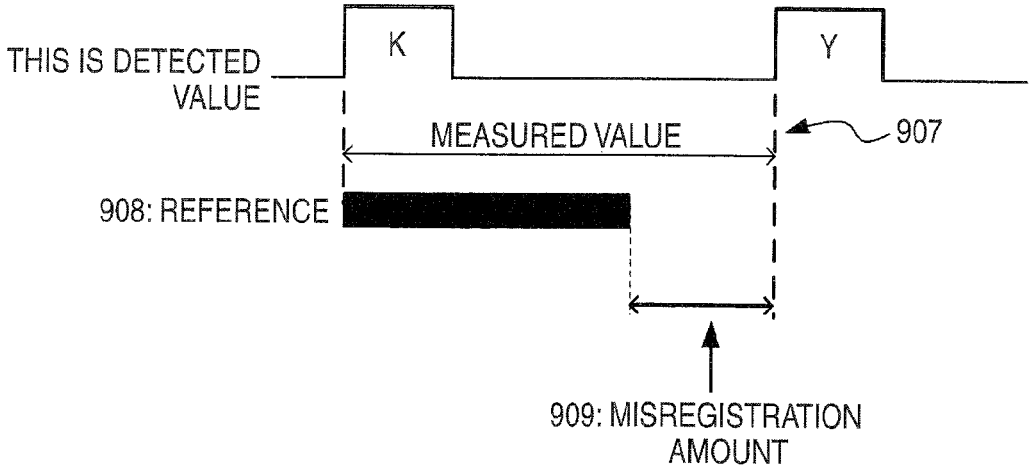
Figure 10:
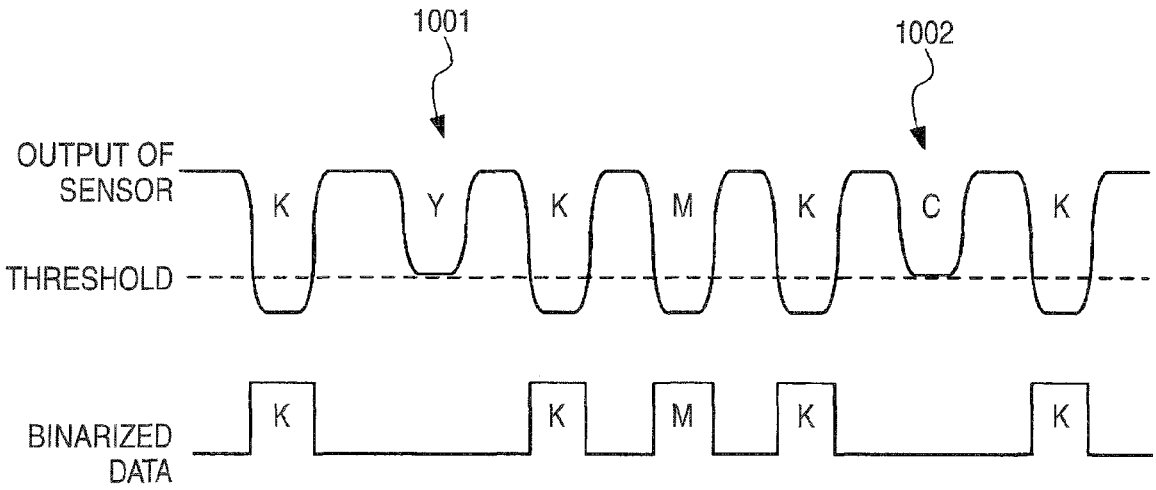
FIG. 10 is a view showing a sensor output in which conventional patch detection fails.

As shown in FIG. 9C, the patch interval measuring portion 19 compares the measurement value (reference numeral 907) which is in the data sent from the binarizing portion 18, and which is obtained by measuring the length from the position where K (black) starts to be written to that where Y (yellow) starts to be written, with the reference value (reference numeral 908) which is common for the all modes (the V mode, the (½)V mode, and the (⅓)V mode) to calculate the misregistration amount (reference numeral 909) (step 804).

The misregistration amount is calculated not only with respect to K (black) and Y (yellow), but also with respect to K (black) and M (magenta), and K (black) and C (cyan), as far as a misregistration amount exists therebetween.

The misregistration amount calculated by the patch interval measuring portion 19 is sent to the registration adjusting portion 20. The registration adjusting portion 20 performs controls such as that the writing timing of the image writing controlling portion 21 is adjusted so as to eliminate the misregistration amount (step 805).

The control in which the misregistration amount is calculated from the regi adjustment patches in the case where the moving speed of the transfer/conveyor belt 11 is V and the writing timing or the like is controlled can be reflected also in the printing process in another printing speed.

Moreover, the control in which the misregistration amount is calculated from the regi adjustment patches in the case where the moving speed of the transfer/conveyor belt 11 is (½)V and the writing timing or the like is controlled can be reflected also in the printing process in another printing speed.

Furthermore, the control in which the misregistration amount is calculated from the regi adjustment patches in the case where the moving speed of the transfer/conveyor belt 11 is (⅓)V and the writing timing or the like is controlled can be reflected also in the printing process in another printing speed.

The control in which the misregistration amount is calculated from the regi adjustment patches corresponding to the moving speed of the transfer/conveyor belt 11 and the writing timing or the like is controlled can be reflected also in the printing process in another printing speed.

Alternatively, the registration adjustment may be performed in the following manner. The lengths and intervals of regi adjustment patches corresponding to the moving speed of the transfer/conveyor belt 11 are not previously stored in the setting information storing portion 23. On the basis of the moving speed V" of the transfer/conveyor belt 11, the length of a regi adjustment patch of K (black) is calculated as "(V"/V)×Dk(c)", and the patch interval between the patch of K (black) and the patch of Y (yellow) is calculated as "(V"/V)×Dk_y(c)". The lengths of regi adjustment patches for the other colors and the patch intervals are similarly calculated. Regi adjustment patches are formed on the basis of the calculated values. Also in the alternative, the registration adjustment is performed by conducting the processes of steps 803, 804, and 805.

Although the image forming apparatus 1 has been described as a tandem type image forming apparatus using the direct transfer system, a tandem type image forming apparatus using the secondary transfer system may be used.

The invention is useful in an image forming apparatus.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

a plurality of image forming units that form toner images of different colors, respectively;

an image carrier onto which the color toner images respectively formed by the image forming units are transferred, and which carries the color toner images;

a first operation controlling unit that performs a first operation control of driving the image forming units and the image carrier in accordance with a printing speed that is selectively designated from a plurality of printing speeds, and transferring the color toner images formed by the image forming units to a recording medium;

a second operation controlling unit that performs a second operation control of activating a position deviation correction mode where position deviations of the toner images formed by the image forming units are corrected, driving the image forming units and the image carrier, and forming image position deviation correction patterns of the colors on the image carrier, the patterns having a size and axisto-axis distance that correspond to the currently set printing speed;

a density detecting sensor that detects densities of the images formed on the image carrier;

a measuring unit that binarizes a density detection output of the image position deviation correction patterns formed on the image carrier, from the density detecting sensor, and that measures intervals between color patterns of the image position deviation correction patterns, based on the binarized output; and a position deviation correction controlling unit that performs a position deviation correcting control of, when the intervals measured by the measuring unit and of the color patterns in the image position deviation correction patterns are deviated from a predetermined range, correcting position deviation of the toner images formed by the image forming units.

2. The image forming apparatus according to claim 1, wherein the apparatus further comprises a storing unit that stores the size and axis-to-axis distance of the image position deviation correction pattern that is formed in the second operation control, and that corresponds to the currently set printing speed.

3. The image forming apparatus according to claim 1, wherein the size and axis-to-axis distance of the image position deviation correction pattern that is formed in the second operation control are proportional to the set printing speed.

4. The image forming apparatus according to claim 2, wherein the size and axis-to-axis distance of the image position deviation correction pattern that is formed in the second operation control are proportional to the set printing speed.

* * * * *